US008487823B2

(12) United States Patent
Quan et al.

(10) Patent No.: US 8,487,823 B2
(45) Date of Patent: Jul. 16, 2013

(54) SWITCHABLE MICROWAVE FLUIDIC POLARIZER

(75) Inventors: Clifton Quan, Arcadia, CA (US); Mark Hauhe, Hermosa Beach, CA (US)

(73) Assignee: Raytheon Company, Waltham, MA (US)

( * ) Notice: Subject to any disclaimer, the term of this patent is extended or adjusted under 35 U.S.C. 154(b) by 771 days.

(21) Appl. No.: 12/617,509

(22) Filed: Nov. 12, 2009

(65) Prior Publication Data

US 2011/0109519 A1 May 12, 2011

(51) Int. Cl.
*H01Q 19/00* (2006.01)

(52) U.S. Cl.
USPC ..... 343/756

(58) Field of Classification Search
USPC ..... 343/756, 909
See application file for complete search history.

(56) References Cited

U.S. PATENT DOCUMENTS 4,498,086 A 2/1985 Sandler
5,014,022 A 5/1991 Wolfson et al.
6,202,748 B1 * 3/2001 Carisella et al. ..... 166/187
6,674,340 B2 1/2004 Quan et al.
6,870,511 B2 * 3/2005 Lynch et al. ..... 343/767
7,053,849 B1 5/2006 Pike et al.
7,262,734 B2 8/2007 Wood
2003/0132890 A1 7/2003 Rawnick et al.
2004/0125019 A1 7/2004 Rawnick et al.
2005/0017905 A1 * 1/2005 Rawnick et al. ..... 343/700 MS
2005/0048934 A1 3/2005 Rawnick et al.
2005/0237267 A1 * 10/2005 Brown et al. ..... 343/909
2007/0188398 A1 8/2007 Mohuchy et al.

OTHER PUBLICATIONS

Lake, "Liquid Metal Antenna", http://www.hamdomain.com/lm-antenna/, Jun. 9, 2009 (4 pgs.).
Extended European Search Report for European Application No. 11161314.7, Extended European Search Report dated Sep. 15, 2011 and mailed Sep. 23, 2011 (8 pgs.).

* cited by examiner

*Primary Examiner* — Robert Karacsony
(74) *Attorney, Agent, or Firm* — Christie, Parker & Hale, LLP

(57) ABSTRACT

A switchable microwave fluidic polarizer is provided. In one embodiment, the invention relates to a switchable polarizer for polarizing radio frequency (RF) signals associated with an antenna, the switchable polarizer including a plurality of radiating elements, an RF feed coupled to the plurality of radiating elements, an antenna input coupled to the RF feed, and an antenna cover disposed in proximity to the plurality of radiating elements, the antenna cover including a dielectric substrate including a plurality of channels for enclosing a liquid metal.

29 Claims, 10 Drawing Sheets

Fusible alloy melting points

| Composition | °C | Name |
|---|---|---|
| Cs 77.0, K 23.0 | −48 | |
| Hg 100 | −39 | |
| Ga 68.5, In 21.5, Sn 10 | −19 | Galinstan |
| K 78.0, Na 22.0 | −11 | NaK |
| Ga 62.5, In 21.5, Sn 16.0 | 10.7 | |
| Ga 69.8, In 17.6, Sn 12.5 | 10.8 | |
| Ga 100 | 30 | |
| Bi 40.63, Pb 22.1, In 18.1, Sn 10.65, Cd 8.2 | 46.5 | |
| Bi 32.5, In 51.0, Sn 16.5 | 60.5 | Field's metal |
| Bi 50.0, Pb 25.0, Sn 12.5, Cd 12.5 | 70 | Wood's metal |
| Bi 50.0, Pb 31.2, Sn 18.8 | 97 | Newton's metal |
| Bi 50.0, Pb 28.0, Sn 22.0 | 109 | Rose's metal |
| Sn 63.0, Pb 37.0 | 183 | Eutectic solder |
| Sn 92.0, Zn 8.0 | 199 | Tin foil |

FIG. 5

SWITCHABLE MICROWAVE FLUIDIC POLARIZER

BACKGROUND

This invention relates to radar and communication systems. More particularly, the invention relates to a switchable microwave fluidic polarizer for changing the polarization of signals associated with an antenna.

The trend toward lower cost and lighter weight active array antennas for radar systems has caused the focus on array architecture to evolve from developing brick and tile subarray assemblies toward thinner and lighter multilayer printed circuit board (PCB) panel subarray assemblies. In some antenna systems, monolithic microwave integrated circuit (MMIC) devices that can make up the transmit/receive (TR) modules are now generally mounted directly to the panel subarray.

A linearly polarized wave may be converted to a circularly polarized wave by means of a panel which provides a 90 degree difference in transmission phase between two crossed linear components. The panel is generally a meander line plate which is a dielectric slab with etched copper meander lines. The electric field of the wave incident to the panel is separated into two equal orthogonal components parallel (E-parallel) and perpendicular (E-perpendicular) to the meander line axis. The E-parallel components are delayed due to the inductive effective, and the E-perpendicular component is advanced due to the capacitive effect of the grating structure of the meander-line polarizers.

The meander-line polarizer has the advantages of broadband frequency operation with low insertion loss and ease of manufacturing. In the past, meander-line polarizers have been used to effect linear-to-circular polarization conversion and to cause a 90 degree rotation of a linearly polarized signal. The meander-line polarizer would then consist of several printed circuit sheets with etched-copper meander lines. The challenge for the future is adding such functionality in front of an active array antenna that is switchable and reconfigurable.

SUMMARY OF THE INVENTION

Aspects of the present invention relate to a switchable microwave fluidic polarizer. In one embodiment, the invention relates to a switchable polarizer for polarizing radio frequency (RF) signals associated with an antenna, the switchable polarizer/antenna including a plurality of radiating elements, an RF feed coupled to the plurality of radiating elements, an antenna input coupled to the RF feed, and an antenna cover disposed in proximity to the plurality of radiating elements, the antenna cover including a dielectric substrate including a plurality of channels for enclosing a liquid metal.

In one embodiment, in a first state, the switchable polarizer is configured to allow incident signals to pass without affecting a polarization of the incident signals, and, in a second state, the switchable polarizer is configured to change the polarization of incident signals from a linear polarization to a circular polarization. In such case, the channels are substantially empty of the liquid metal in the first state, and the channels are substantially filled with the liquid metal in the second state.

In another embodiment, the invention relates to a process for operating a switchable polarizer including an antenna cover disposed in proximity to a plurality of radiating elements, the antenna cover including a dielectric substrate having a plurality of channels for enclosing a liquid metal, the process including filling the plurality of channels with a liquid metal, in a first state, to change a polarization of signals incident to the switchable polarizer from a linear polarization to a circular polarization, and removing the liquid metal from the plurality of channels, in a second state, to allow signals incident to the switchable polarizer to pass without affecting the polarization of the incident signals.

BRIEF DESCRIPTION OF THE DRAWINGS

FIG. 5 is a table listing melting points for various alloys that might be used as a liquefied metal in accordance with one embodiment of the invention.

DETAILED DESCRIPTION OF THE INVENTION

Referring now to the figures, embodiments of the switchable polarizer include a dielectric material having a number of meander-line channels formed therein to enclose a liquid metal. In operation, the liquid metal can be forced into the meander-line channels using a pump or other means. In one embodiment, the same pump can be used to extract the liquid metal from the meander-line channels. When the meander-line channels are filled with liquid metal, embodiments of the switchable polarizers can change the polarization of signals incident to the switchable polarizer. When the channels are empty, embodiments of the switchable polarizers can leave unchanged the polarization of signals incident to the switchable polarizer (e.g., the switchable polarizer can be effectively transparent to the signals). In several embodiments, the dielectric material takes a sheet-like form that may include a number of dielectric layers and multiple arrays of meander-line channels. In some embodiments, a second pump is included to force the liquid metal from the meander-line channels.

Figure 1:
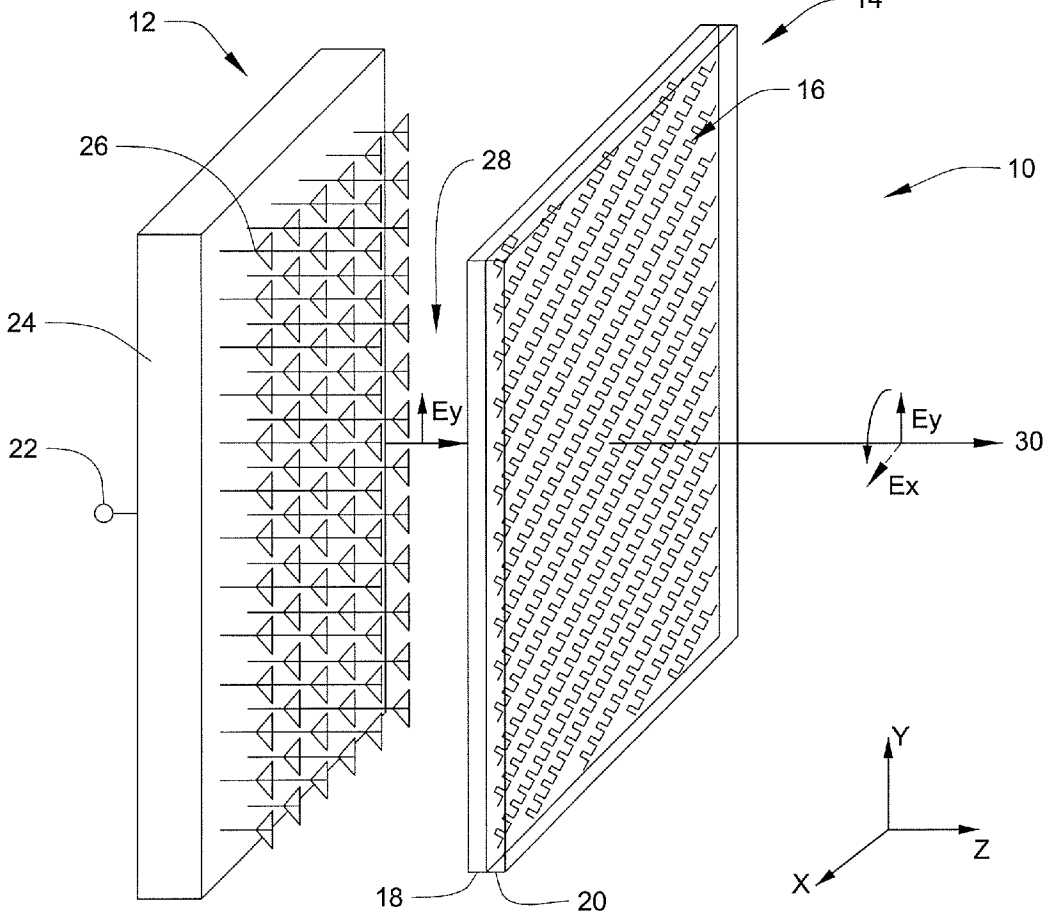
FIG. 1 is a perspective view of a switchable microwave polarizer including a radio frequency (RF) antenna and an antenna cover or radome in accordance with one embodiment of the invention.

FIG. 1 is a perspective view of a switchable microwave polarizer including a radio frequency (RF) antenna 12 and an antenna cover or radome 14 in accordance with one embodiment of the invention. The radome 14 includes a number of meander-line channels 16 disposed within two dielectric sheets 18, 20. The meander-line channels 16 can contain liquefied metal (not shown) which can be controlled by a pump (not shown). The antenna 12 is an array antenna including an input/output port 22, an RF feed 24 and an array of radiating elements 26. In some embodiments, the array antenna is an active array antenna for use with a radar system.

In operation, the array antenna 12 generates one or more radiated signals 28 incident to the radome 14. When the meander-line channels are filled with the liquefied metal, the polarizer can change the polarization of the radiated incident signals 28 from a linear polarization to a circular polarization to produce a resultant radiated signal 30. When the meander-line channels are empty, the polarizer can appear transparent to signals incident to the radome, and thus polarization of such signals can remain unchanged.

In several embodiments, the two dielectric sheets of the radome are fused together to form the thin channelized cavities in between as shown in FIG. 1. Depending of the size of the desired channels to be formed, examples of thin fusible dielectric sheets include silicon channels that can be designed to act as a microwave transparent radome over the antenna array or antenna aperture. The thickness of the dielectric sheets and buried channels can be designed to act as a microwave transparent randome over the antenna aperture in absence of the liquefied metal. The thickness of the dielectric sheets and buried channels can be calculated using available electromagnetic modeling software tools and design procedures, depending on the dielectric constant and desired frequency of operation. In the embodiment illustrated in FIG. 1, the switchable polarizer is configured to work with RF signals. In other embodiments, the switchable polarizer can be used with signals of other frequencies.

In some embodiments, low temperature liquefied metal can be pumped into the channelized cavities to create the conductor pattern for a meander-line polarizer as shown in FIG. 1. Likewise the liquefied metal can be removed from the channels by using the same pump to draw a vacuum. Depending on the channel sizes, small and light weight pumps are able to fill and remove the liquefied metal at the speed of sound and require little power. In such case, the switchable polarizer can be used for many future antenna platforms in air, space and ground applications. In other embodiments, the switchable polarizer can use multiple pumps to control the flow of the liquefied metal in and out of the channels. This approach can be expanded to a system of multiple layers of switchable low temperature liquefied metal for enhanced polarization performance. In some embodiments, the switchable microwave polarizer can be used with a complex three dimensional curved surface. In a number of embodiments, the finite thickness of the liquefied metal in the channels allows the new switchable polarizer to handle both low and very high power applications.

In the embodiment illustrated in FIG. 1, two sheets of dielectric material are fused to form the meander-line channels. In other embodiments, more than two sheets can be used to form one or more arrays of meander-line channels. In one embodiment, a single dielectric sheet can be used to enclose the meander-line channels.

Figure 2:
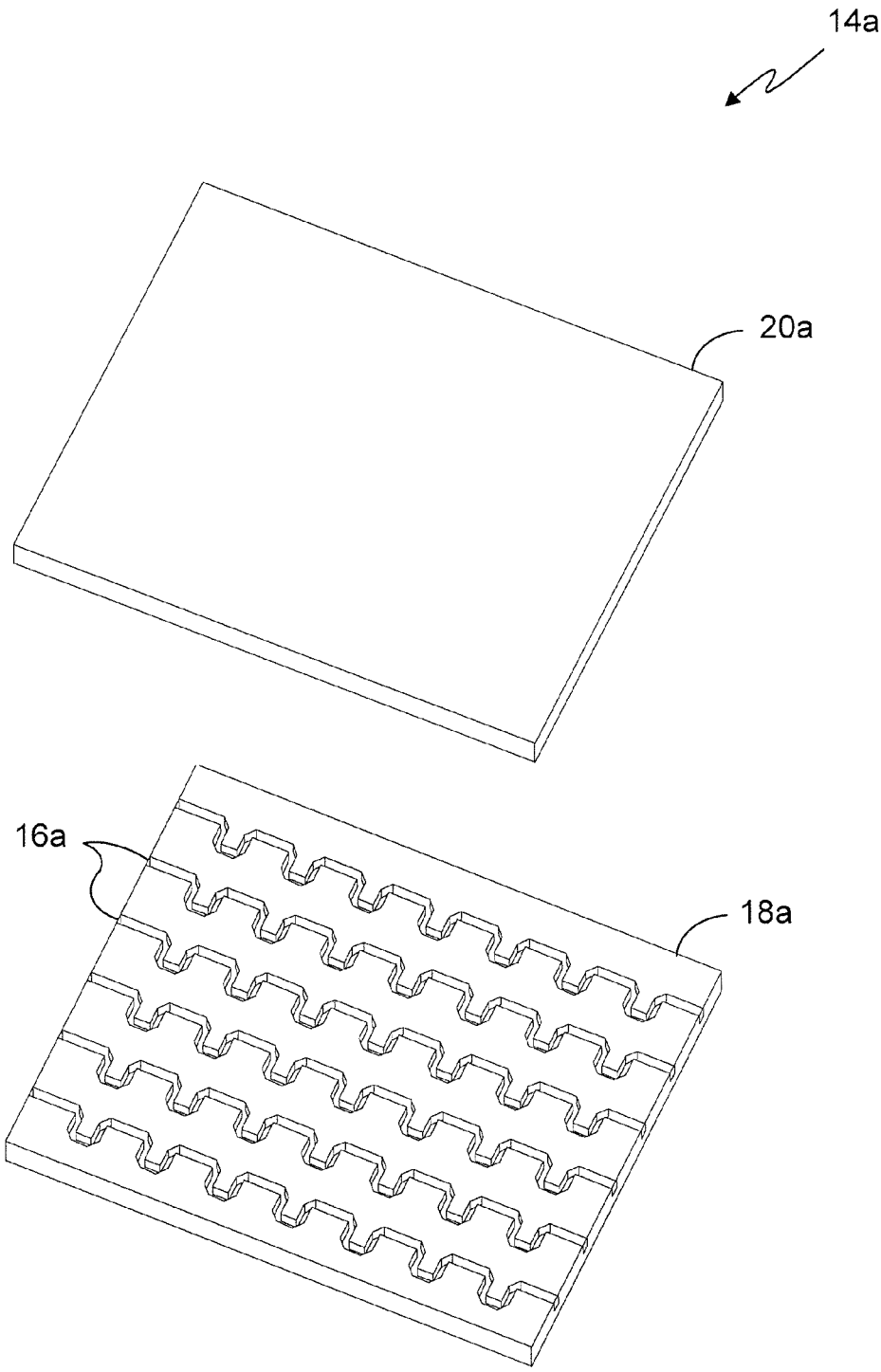
FIG. 2 is a exploded perspective view of a radome including a first dielectric substrate having a number of meander-line channels and a second dielectric substrate acting as a cover in accordance with one embodiment of the invention.

FIG. 2 is a exploded perspective view of a radome 14*a* including a first dielectric substrate 18*a* having a number of meander-line channels 16*a* and a second dielectric substrate 20*a* acting as a cover in accordance with one embodiment of the invention. The channels 16*a* can be etched into the first dielectric substrate 18*a* using machining, molding or other processes known in the art. In the embodiment illustrated in FIG. 2, the channels or channel cavities are etched to form a repeating S-shaped channel. In other embodiments, other channel shapes suitable to polarize radiated incident signals to the radome can be used. In the embodiment illustrated in FIG. 2, the channels or channel cavities have a particular size. In other embodiments, other size channels can be used. In one embodiment, the dielectric substrates can be made of silicon glass, polished ceramics, printed circuit boards and/or other suitable materials.

Figure 3:
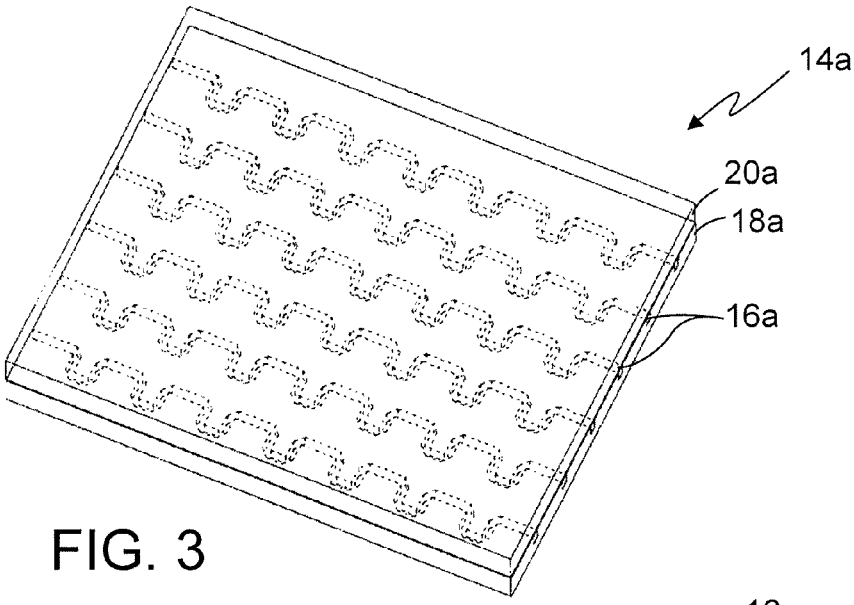
FIG. 3 is a perspective view of the radome having the first substrate and the second substrate cover of FIG. 2 fused together.

FIG. 3 is a perspective view of the radome 14*a* of FIG. 2 having the first dielectric substrate 18*a* and the second dielectric substrate cover 20*a* fused together to enclose a number of meander-line channels 16*a*.

Figure 4:
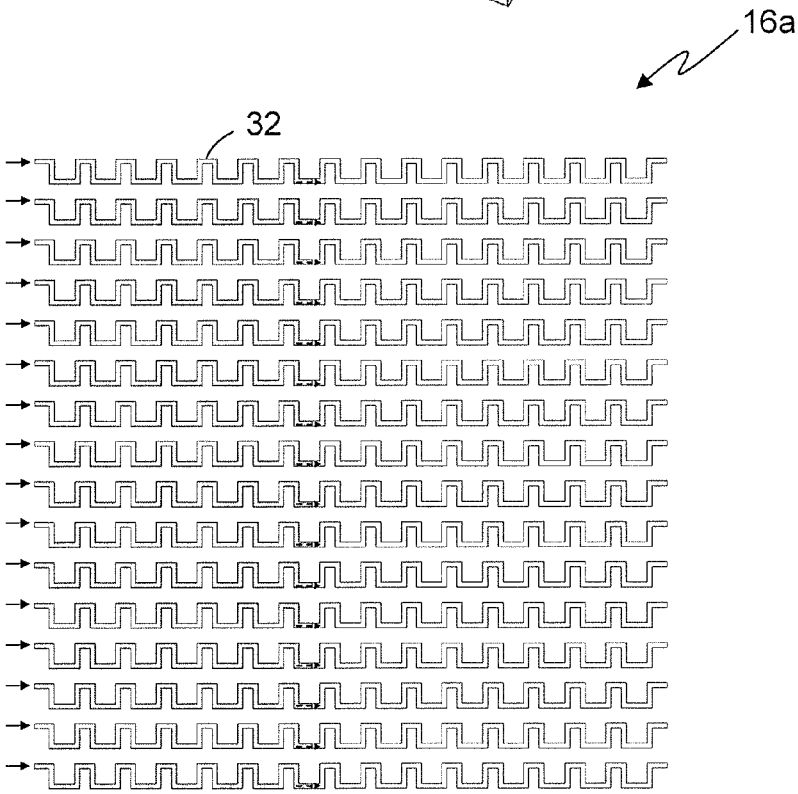
FIG. 4 is a top view of a number of meander-line channels partially filled with a liquefied metal in accordance with one embodiment of the invention.

FIG. 4 is a top view of a number of meander-line channels 16*a* partially filled with a liquefied metal in accordance with one embodiment of the invention. In operation, pumps (not shown) can be used to fill one or more of the meander-line channels 16*a* with a liquefied metal. In one embodiment, the liquefied metal is a low temperature liquefied metal such as Galinstan. In other embodiments, other suitable low temperature liquefied metals can be used.

FIG. 5 is a table listing melting points for various alloys that might be used as a liquefied metal in accordance with one embodiment of the invention. In one embodiment, the switchable polarizer can use any one, or a combination, of the top three alloys as a liquefied metal for use in the meander-line channels. In other embodiments, other suitable liquefied metals can be used.

Figure 6:
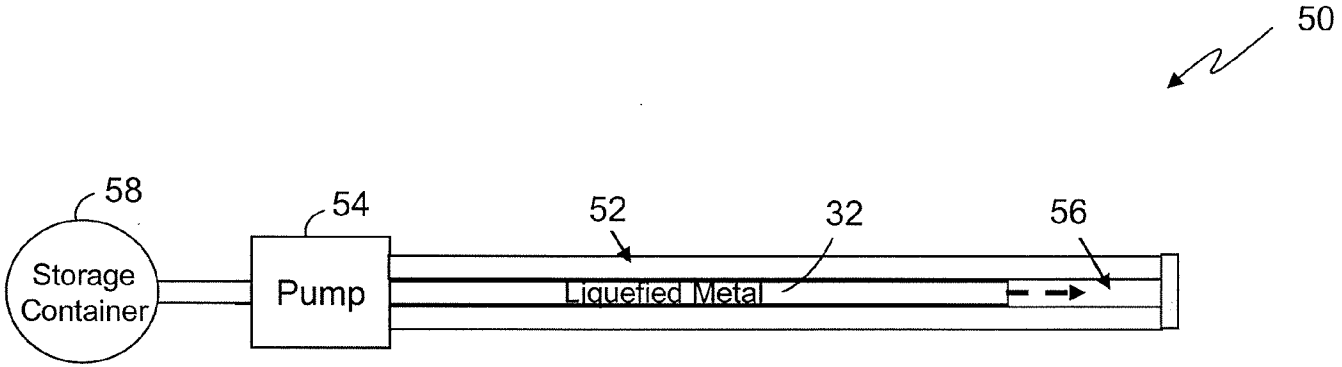
FIG. 6 is a schematic block diagram illustrating a system having a pump for controlling a flow of liquefied metal in one or more meander-line channels in accordance with one embodiment of the invention.

FIG. 6 is a schematic block diagram illustrating a system 50 having a pump 54 for controlling a flow of a liquefied metal 32 in one or more meander-line channels 52 in accordance with one embodiment of the invention. The system includes the meander-line channel 52 of a radome enclosing the liquefied metal 32 and an air dielectric 56. The pump 54 is coupled to one end of the meander-line channel 52 and to a storage container 58 for storing the liquefied metal 32. In several embodiments, the pump 54 is used to move the liquefied metal 32 from the storage container 58 into the meander-line channel 52, and/or additional meander-line channels, to form a switchable polarizer. The same pump 54 can be used to draw a vacuum to pull the liquefied metal out of the channels and back into the storage container 58.

Figure 7:
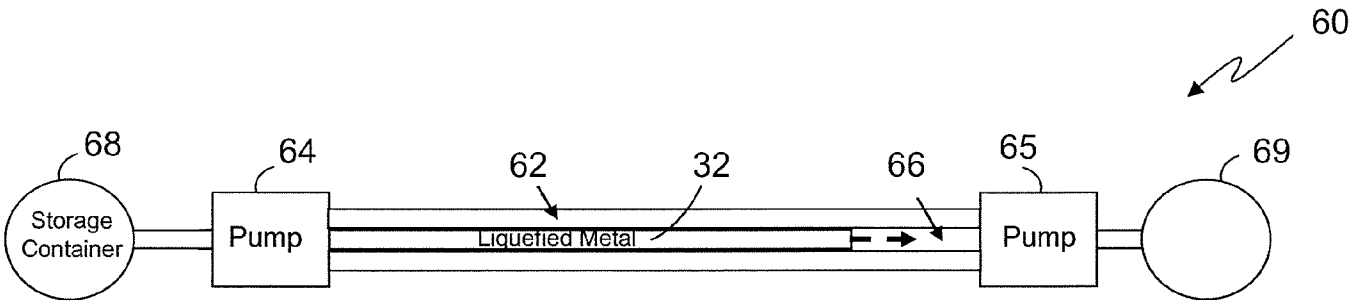
FIG. 7 is a schematic block diagram illustrating a system having two pumps for controlling a flow of liquefied metal in one or more meander-line channels in accordance with one embodiment of the invention.

FIG. 7 is a schematic block diagram illustrating a system 60 having two pumps (64, 65) for controlling a flow of liquefied metal 32 in one or more meander-line channels 62 in accordance with one embodiment of the invention. The system 60 includes the one or more meander-line channels 62 of a radome enclosing the liquefied metal 32 and an air dielectric 66. The first pump or metal pump 64 is coupled to one end of the meander-line channel 62 and to a metal storage container 68 for storing the liquefied metal 32. The second pump or air pump 65 is coupled to the other end of the meander-line channel 62 and to an air storage container 69 for storing the air dielectric 66. In several embodiments, the metal pump 64 is used to move the liquefied metal 32 from the metal storage container 68 into the meander-line channel 62, and/or additional meander-line channels, to form a switchable polarizer. The air pump 65 can be used to force air 66 into the channels 62 to push the liquefied metal 32 out of the channels 62 and back into the metal storage container 68.

Figure 8A:
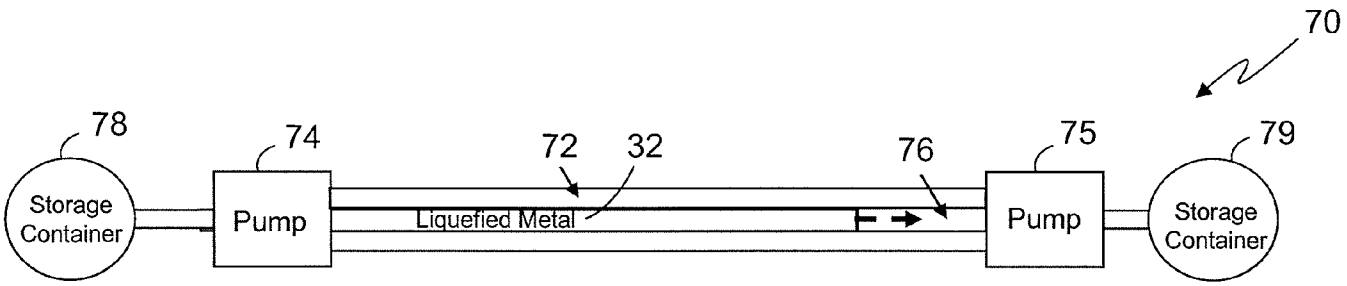
FIG. 8*a* is a schematic block diagram illustrating a system having two pumps for controlling a flow of liquefied metal in one or more meander-line channels in accordance with one embodiment of the invention.

FIG. 8*a* is a schematic block diagram illustrating a system 70 having two pumps (74, 75) for controlling a flow of liquefied metal 32 in one or more meander-line channels 72 in accordance with one embodiment of the invention. The system 70 includes the one or more meander-line channels 72 of a radome enclosing the liquefied metal 32 and a liquid dielectric 76. The first pump or metal pump 74 is coupled to one end of the meander-line channel 72 and to a metal storage container 78 for storing the liquefied metal 32.

The second pump or dielectric pump 75 is coupled to the other end of the meander line channel 72 and to an dielectric storage container 79 for storing the liquid dielectric 76. In several embodiments, the metal pump 74 is used to move the liquefied metal 32 from the metal storage container 78 into the meander-line channel 72, and/or additional meander-line channels, to form a switchable polarizer. The dielectric pump 75 can be used to force the liquid dielectric 76 into the channels 72 and to push the liquefied metal 32 out of the channels 72 and back into the metal storage container 78.

Figure 8B:
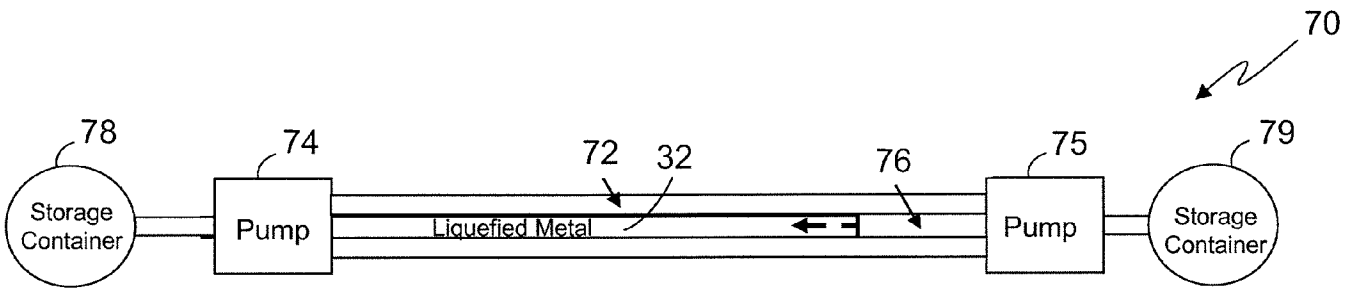
FIG. 8*b* is a schematic block diagram of the system of FIG. 8*a* as one of the pumps forces a liquid dielectric into the meander-line channel to move the liquefied metal back into the storage container.

FIG. 8*b* is a schematic block diagram illustrating the system of FIG. 8*a* as the dielectric pump 75 forces the liquid dielectric 76 into the meander-line channel 72 to move the liquefied metal 32 back into the metal storage container 78.

Figure 9A:
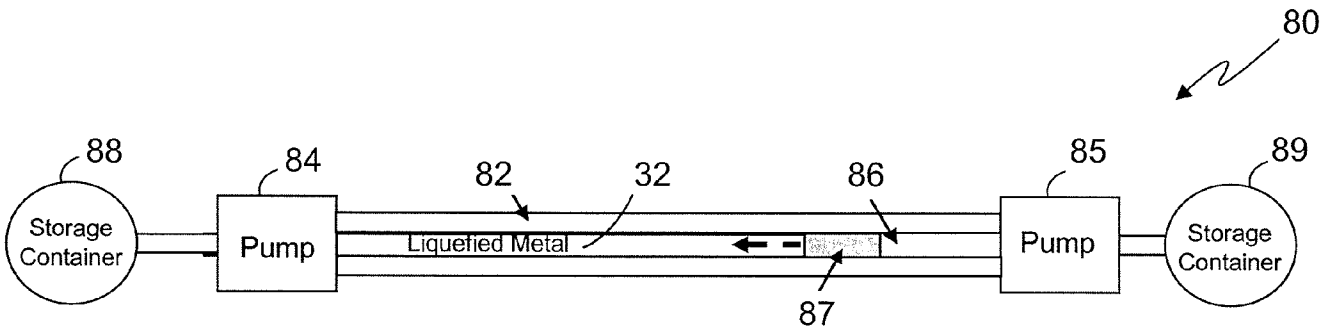
FIG. 9*a* is a schematic block diagram illustrating a system having two pumps for controlling a flow of liquefied metal in a meander-line channel having a sliding piston for isolating fluids controlled by each pump in accordance with one embodiment of the invention.

FIG. 9*a* is a schematic block diagram illustrating a system 80 having two pumps (84, 85) for controlling a flow of liquefied metal 32 in a meander-line channel 82 having a sliding piston 87 for isolating fluids controlled by each pump in accordance with one embodiment of the invention. The system 80 includes the one or more meander-line channels 82 of a radome enclosing the liquefied metal 32, a solid piston 87, and a liquid dielectric 86. The first pump or metal pump 84 is coupled to one end of the meander-line channel 82 and to a metal storage container 88 for storing the liquefied metal 82. The second pump or dielectric pump 85 is coupled to the other end of the meander-line channel 82 and to an dielectric storage container 89 for storing the liquid dielectric 86.

In several embodiments, the metal pump 84 is used to move the liquefied metal 32 from the metal storage container 88 into the meander-line channel 82, and/or additional meander line channels, to form a switchable polarizer. The dielectric pump 85 can be used to force the liquid dielectric 86 into the channels 82 and to push the liquefied metal 32 out of the channels 82 and back into the metal storage container 88. The solid piston 87 can be placed between the liquefied metal 32 and the liquid dielectric 86 to prevent mixing of the two fluids. The solid piston 87 can then be moved within the meander-line channel 82 based on the pressure applied from either of the two fluids. In the embodiment illustrated in FIG. 9*a*, the solid piston 87 is receiving greater pressure from the liquid dielectric 86 and is therefore being moved away from the dielectric pump 85.

Figure 9B:
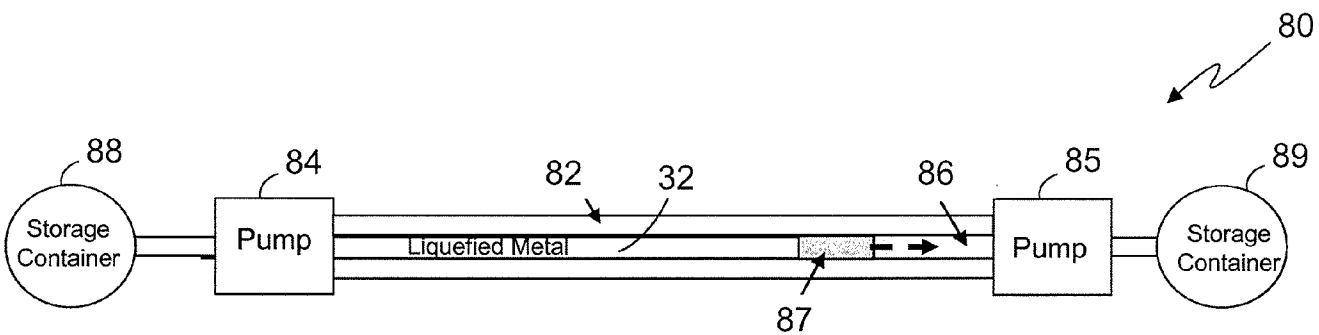
FIG. 9*b* is a schematic block diagram illustrating the system of FIG. 9*a* as the sliding piston is moved in the opposite direction.

FIG. 9*b* is a schematic block diagram illustrating the system of FIG. 9*b* as the sliding piston is moved in the opposite direction.

Figure 10:
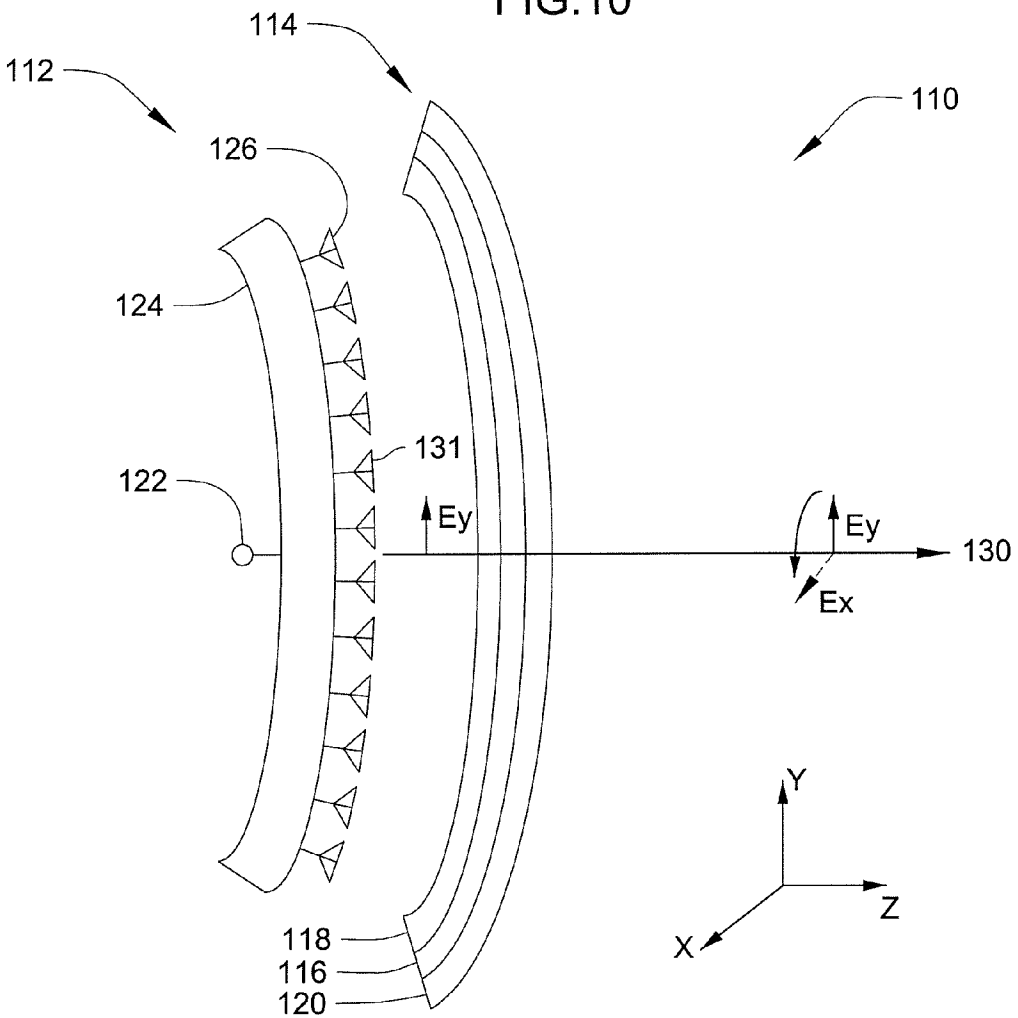
FIG. 10 is a schematic block diagram of a switchable microwave polarizer having a curved cover and a radio frequency (RF) antenna in accordance with one embodiment of the invention.

FIG. 10 is a schematic block diagram of a switchable microwave polarizer 110 having a curved radome or cover 114 and a radio frequency (RF) antenna 112 in accordance with one embodiment of the invention. The radome 114 includes a number of meander-line channels 116 disposed within, or between, two dielectric sheets 118, 120. The meander-line channels 116 can contain liquefied metal (not shown) which can be controlled by a pump (not shown). The antenna 112 is a conformal array antenna including an input/output port 122, a curved RF feed 124 and an array of radiating elements 126 disposed on a surface of the RF feed 124.

In operation, the array antenna 112 generates one or more radiated signals 128 incident to the curved radome 114. The meander-line channels 116 containing the liquefied metal change the polarization of the radiated incident signals 128 from a linear polarization to a circular polarization to produce a resultant radiated signal 130. In one embodiment, the meander-line channels 116 can also contain an air dielectric.

In several embodiments, the switchable polarizer can operate as described above for the embodiments of FIG. 1.

Figure 11:
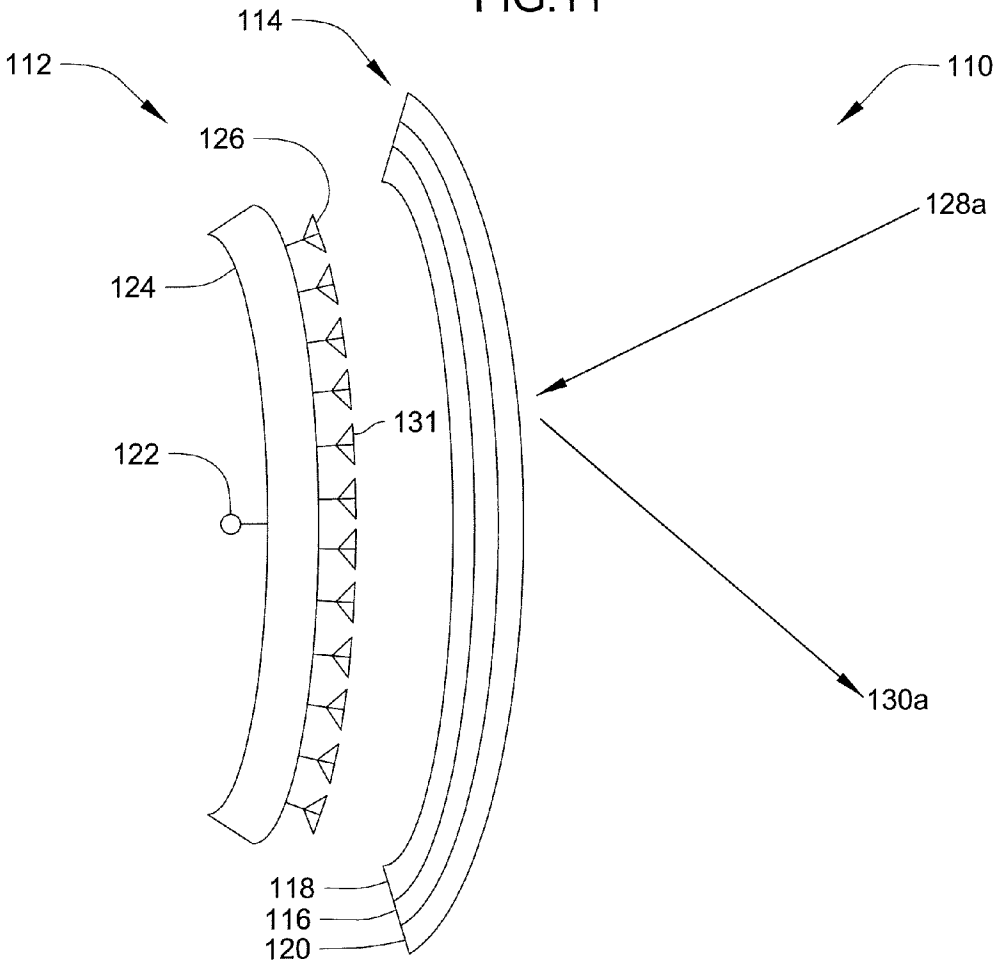
FIG. 11 is a schematic block diagram illustrating use of the switchable microwave polarizer of FIG. 10 with an outside radiated incident signal rather than a radiated incident signal from the RF antenna.

FIG. 11 is a schematic block diagram illustrating use of the switchable microwave polarizer 110 of FIG. 10 with an outside radiated incident signal 128*a* rather than a radiated incident signal from the RF antenna 112. In operation, the outside radiated incident signal 128*a* can be changed from a linear polarization to a circular polarization and can produce a outside radiated reflect signal 130*a* and a signal 131 from the outside radiated incident signal 128*a* received by one or more radiating elements.

Figure 12:
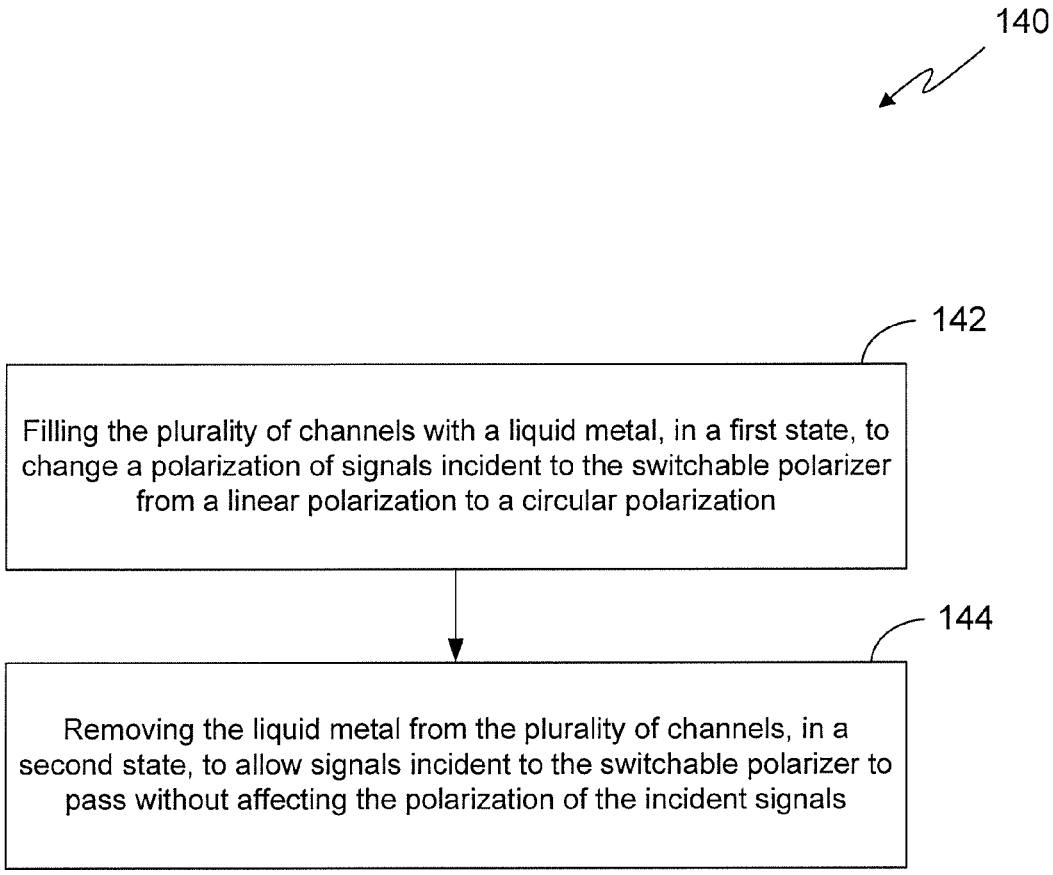
FIG. 12 is a flow chart illustrating a process for operating a switchable polarizer in accordance with one embodiment of the invention.

FIG. 12 is a flow chart illustrating a process 140 for operating a switchable polarizer in accordance with one embodiment of the invention. In a number of embodiments, the switchable polarizer (not shown) can include an antenna cover disposed in proximity to a plurality of radiating elements, where the antenna cover includes a dielectric substrate having a plurality of channels for enclosing a liquid metal. The process 140 can fill (142) the plurality of channels with a liquid metal, in a first state, to change a polarization of signals incident to the switchable polarizer from a linear polarization to a circular polarization. The process can remove (144) the liquid metal from the plurality of channels, in a second state, to allow signals incident to the switchable polarizer to pass without affecting the polarization of the incident signals. In several embodiments, the process is executed by a control system coupled to one or more pumps configured to fill and remove liquid metal from the channels of the switchable polarizer.

In some embodiments, the process does not perform all of the actions described. In one embodiment, the process performs the actions in a different order than illustrated in the flow chart of FIG. 12. In some embodiments, the process performs some of the actions simultaneously.

While the above description contains many specific embodiments of the invention, these should not be construed as limitations on the scope of the invention, but rather as examples of specific embodiments thereof. Accordingly, the scope of the invention should be determined not by the embodiments illustrated, but by the appended claims and their equivalents.

What is claimed is:

1. A switchable polarizer for polarizing radio frequency (RF) signals associated with an antenna, the switchable polarizer comprising:

a plurality of radiating elements;

an RF feed coupled to the plurality of radiating elements;

an antenna input coupled to the RF feed; and an antenna cover disposed in proximity to the plurality of radiating elements, the antenna cover comprising:

a dielectric substrate comprising a plurality of channels for enclosing a liquid metal;

wherein, in a first state, the switchable polarizer is configured to allow incident signals to pass without affecting a polarization of the incident signals;

wherein, in a second state, the switchable polarizer is configured to change the polarization of the incident signals from a linear polarization to a circular polarization;

wherein the plurality of channels are substantially empty of the liquid metal in the first state; and wherein the plurality of channels are substantially filled with the liquid metal in the second state.

2. The switchable polarizer of claim 1, wherein the dielectric substrate comprises:

a first dielectric sheet comprising the channels; and a second dielectric sheet fused to the first dielectric sheet to enclose the plurality of channels.

3. The switchable polarizer of claim 2, wherein the plurality of channels comprise an array of channels disposed within the dielectric substrate.

4. The switchable polarizer of claim 3, wherein the array of channels comprise a plurality of meander-line channels.

5. The switchable polarizer of claim 1, further comprising:

a pump coupled to at least one of the plurality of channels, the pump configured to move the liquid metal into, and out of, the at least one of the plurality of channels.

6. The switchable polarizer of claim 5, wherein the pump is coupled to each of the plurality of channels.

7. The switchable polarizer of claim 1, further comprising:

a first pump coupled to at least one of the plurality of channels, the first pump configured to move the liquid metal into the at least one channel; and a second pump coupled to the at least one channel, the second pump configured to move the liquid metal out of the at least one channel.

8. The switchable polarizer of claim 7, wherein the second pump is configured to pump an air dielectric into the at least one channel.

9. The switchable polarizer of claim 7, wherein the second pump is configured to pump a liquid dielectric into the at least one channel.

10. The switchable polarizer of claim 9, further comprising a movable piston disposed within the at least one channel and between the liquid metal and the liquid dielectric.

11. The switchable polarizer of claim 1, wherein the dielectric substrate comprises a flat rectangular sheet.

12. The switchable polarizer of claim 1, wherein the dielectric substrate comprises at least one curved surface.

13. The switchable polarizer of claim 1, wherein the plurality of channels comprise a plurality of meander-line channels.

14. The switchable polarizer of claim 13, wherein at least one of the plurality of meander-line channels has a repeating S-shape.

15. A process for operating a switchable polarizer comprising an antenna cover disposed in proximity to a plurality of radiating elements, the antenna cover comprising a dielectric substrate having a plurality of channels for enclosing a liquid metal, the process comprising:

filling the plurality of channels with a liquid metal, in a first state, to change a polarization of signals incident to the switchable polarizer from a linear polarization to a circular polarization; and removing the liquid metal from the plurality of channels, in a second state, to allow signals incident to the switchable polarizer to pass without affecting the polarization of the incident signals.

16. The process for operating the switchable polarizer of claim 15, wherein the dielectric substrate comprises:

a first dielectric sheet comprising the plurality of channels; and a second dielectric sheet fused to the first dielectric sheet to enclose the plurality of channels.

17. The process for operating the switchable polarizer of claim 16, wherein the plurality of channels comprise an array of meander-line channels disposed within the dielectric substrate.

18. The process for operating the switchable polarizer of claim 15, further comprising:

a pump coupled to at least one of the plurality of channels, the pump configured to move the liquid metal into, and out of, the at least one of the plurality of channels.

19. The process for operating the switchable polarizer of claim 18, wherein the pump is coupled to each of the plurality of channels.

20. The process for operating the switchable polarizer of claim 15, further comprising:

a first pump coupled to at least one of the plurality of channels, the first pump configured to move the liquid metal into the at least one channel; and a second pump coupled to the at least one channel, the second pump configured to move the liquid metal out of the at least one channel.

21. The process for operating the switchable polarizer of claim 20, wherein the second pump is configured to pump an air dielectric into the at least one channel.

22. The process for operating the switchable polarizer of claim 20, wherein the second pump is configured to pump a liquid dielectric into the at least one channel.

23. The process for operating the switchable polarizer of claim 22, further comprising a movable piston disposed within the at least one channel and between the liquid metal and the liquid dielectric.

24. The process for operating the switchable polarizer of claim 15, wherein the dielectric substrate comprises a flat rectangular sheet.

25. The process for operating the switchable polarizer of claim 15, wherein the dielectric substrate comprises at least one curved surface.

26. The process for operating the switchable polarizer of claim 15, wherein the plurality of channels comprise a plurality of meander-line channels.

27. The process for operating the switchable polarizer of claim 26, wherein at least one of the plurality of meander-line channels has a repeating S-shape.

28. A switchable polarizer for polarizing radio frequency (RF) signals associated with an antenna, the switchable polarizer comprising:

a plurality of radiating elements;

an RF feed coupled to the plurality of radiating elements;

an antenna input coupled to the RF feed; and an antenna cover disposed in proximity to the plurality of radiating elements, the antenna cover comprising:

a dielectric substrate comprising a plurality of meander-line channels configured to enclose a liquid metal, wherein the switchable polarizer is configured to switch between a first state and a second state;

wherein the plurality of channels are substantially empty of the liquid metal in the first state;

wherein the plurality of channels are substantially filled with the liquid metal in the second state; and wherein, in the second state, the switchable polarizer is configured to change a polarization of incident signals.

29. A switchable polarizer for polarizing radio frequency (RF) signals associated with an antenna, the switchable polarizer comprising:

a plurality of radiating elements;

an RF feed coupled to the plurality of radiating elements;

an antenna input coupled to the RF feed; and an antenna cover disposed in proximity to the plurality of radiating elements, the antenna cover comprising:

a dielectric substrate comprising a plurality of meander-line channels configured to enclose a liquid metal, wherein the switchable polarizer is configured to switch between a first state and a second state;

wherein the plurality of channels are substantially empty of the liquid metal in the first state;

wherein the plurality of channels are substantially filled with the liquid metal in the second state; and wherein, in the second state, the switchable polarizer is configured to change a polarization of incident signals from a linear polarization to a circular polarization.

* * * * *